US011028849B2

(12) United States Patent
Lee

(10) Patent No.: US 11,028,849 B2
(45) Date of Patent: Jun. 8, 2021

(54) SCROLL COMPRESSOR HAVING A ROTATION SHAFT WITH AN OIL FLOW PATH FORMED THEREIN

(71) Applicant: LG ELECTRONICS INC., Seoul (KR)

(72) Inventor: Munyoung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 328 days.

(21) Appl. No.: 15/887,580

(22) Filed: Feb. 2, 2018

(65) Prior Publication Data

US 2018/0231002 A1 Aug. 16, 2018

(30) Foreign Application Priority Data

Feb. 13, 2017 (KR) ..... 10-2017-0019447

(51) Int. Cl.

| | |
|---|---|
| ***F04C 29/02*** | (2006.01) |
| ***F04C 18/02*** | (2006.01) |
| ***F04C 29/00*** | (2006.01) |
| ***F01C 21/02*** | (2006.01) |

(52) U.S. Cl.

CPC ..... *F04C 29/023* (2013.01); *F01C 21/02* (2013.01); *F04C 18/0215* (2013.01); *F04C 29/005* (2013.01); *F04C 29/028* (2013.01); *F04C 2240/40* (2013.01); *F04C 2240/50* (2013.01); *F04C 2240/603* (2013.01); *F04C 2240/605* (2013.01)

(58) Field of Classification Search

CPC .... F04C 29/023; F04C 29/028; F04C 29/005; F04C 18/0215; F04C 2240/40; F04C 2240/603; F04C 2240/605; F04C 2240/50; F04C 18/0207; F04C 18/0223; F01C 21/02; F04B 39/23–276

See application file for complete search history.

(56) References Cited

U.S. PATENT DOCUMENTS 2,996,240 A * 8/1961 Stocklein ..... F25B 31/002 417/372
4,403,927 A * 9/1983 Butterworth ..... F01C 21/04 184/6.16
4,575,320 A * 3/1986 Kobayashi ..... F25B 31/002 418/55.6
4,623,306 A * 11/1986 Nakamura ..... F04C 29/023 184/6.18
5,007,808 A 4/1991 Fraser, Jr. et al.
5,017,108 A * 5/1991 Murayama ..... F04C 18/0215 418/55.6

(Continued)

FOREIGN PATENT DOCUMENTS

CN 104903583 A 9/2015
EP 0 157 390 A2 10/1985

(Continued)

*Primary Examiner* — Philip E Stimpert
(74) *Attorney, Agent, or Firm* — Dentons US LLP

(57) ABSTRACT

A rotation shaft of a scroll compressor that includes an oil flow path formed therein, an upper frame support portion which is inserted into an upper frame, a boss insertion portion which is recessed from an upper surface of the upper frame support portion for insertion of the boss portion, and an oil residual groove which is recessed at a predetermined depth from a bottom portion of the boss insertion portion.

7 Claims, 9 Drawing Sheets

(56) References Cited

U.S. PATENT DOCUMENTS

| | | | | |
|---|---|---|---|---|
| 2010/0212352 | A1* | 8/2010 | Kim | F04C 18/0215 62/498 |
| 2017/0002816 | A1* | 1/2017 | Uekawa | F04C 29/023 |

FOREIGN PATENT DOCUMENTS

| | | | |
|---|---|---|---|
| EP | 1 160 452 | A2 | 12/2001 |
| JP | 57-151093 | A | 9/1982 |
| JP | 60192894 | A | 10/1985 |
| JP | 6429685 | A | 1/1989 |
| JP | 04262088 | A | 9/1992 |
| JP | 08326668 | A | 12/1996 |
| JP | 09170570 | A | 6/1997 |
| JP | 09317663 | A | 12/1997 |
| KR | 10-2016-0089779 | A | 7/2016 |

* cited by examiner

SCROLL COMPRESSOR HAVING A ROTATION SHAFT WITH AN OIL FLOW PATH FORMED THEREIN

CROSS-REFERENCE TO RELATED APPLICATION

The present application claims the benefits of priority to Korean Patent Application No. 10-2017-0019447, filed on Feb. 13, 2017, which is herein incorporated by reference in its entirety.

BACKGROUND OF THE INVENTION

1. Field of the Invention

The present disclosure relates to a scroll compressor.

2. Description of the Related Art

A scroll compressor is a compressor having a stationary scroll that has a stationary wrap and an orbiting scroll that orbits about the stationary scroll and has an orbiting wrap. During operation, volume of a compression chamber formed between the stationary scroll and the orbiting scroll decreases according to a swivel motion of the orbiting scroll while the stationary scroll and the orbiting scroll are rotated and engaged with each other. Accordingly, the fluid pressure increases and fluid discharges from a discharge port formed at a center portion of the stationary scroll.

Suction, compression, and discharge are continuously performed while the orbiting scroll is swiveling so that a discharge valve and a suction valve are in principle dispensed with. Scroll compressors are advantageous over other compressors because: (1) they have relatively few components, thus the structure is simplified and high-speed rotation is possible; and (2) they have minimal noise and vibration because the fluctuation of torque required for compression is small and suction and compression are continuously performed.

One example of a conventional scroll compressor is disclosed in Korean Patent Application No. 2016-0089779 (Jul. 28, 2016). According to the scroll compressor disclosed in FIG. 5 of that application, oil in an oil flow path formed inside a rotation shaft is pumped in an upward direction by a rotational force (centrifugal force) of the rotation shaft and is supplied to the wrap of the orbiting scroll and the wrap of the stationary scroll (centrifugal refueling system).

According to the centrifugal refueling system, when the compressor operates at a high speed, more oil is supplied to the orbiting and stationary scroll wraps. However, when the compressor operates at a low speed, the supply amount of oil supplied is small and friction between the orbiting scroll and the stationary scroll increases. This can be problem some because the oil sealing effect of the internal portion of the compression portion may be reduced and thus decrease the reliability and performance of the compressor. Additionally, the oil cannot may not be evenly supplied to a bearing member coupled to an outer peripheral surface of the rotation shaft in a main bearing portion coupled to an outer peripheral surface of a boss of the orbiting scroll.

Alternatively, when the compressor is stopped, oil supplied to a boss coupling groove of the rotation shaft is lowered to a bottom of the compressor along the oil flow path, so that no oil remains in the boss coupling groove. In this case, at an initial stage of driving of the compressor, the bearing portion is operated in an oil-free state until oil is supplied to the boss coupling groove. As a result, there is an increased risk of wear of the rotation shaft, the boss of the orbiting scroll, the bearing, and the like.

SUMMARY

The present invention has been made in order to solve the above at least the above problems associated with the conventional technology.

To solve the problems described above, according to an embodiment of the present invention, there is provided a scroll compressor including: a rotation shaft; an upper frame which supports an upper end of the rotation shaft; a lower frame which supports a lower end of the rotation shaft; a motor which is mounted on an outer peripheral surface of the rotation shaft and rotates the rotation shaft; a first scroll which includes a first base plate which is seated on the upper frame and orbits, a first wrap which extends from an upper surface of the first base plate and is formed in a spiral shape, and a boss portion which extends from a bottom surface of the first base plate; and a second scroll which includes a second base plate which covers an upper side of the first scroll, and a second wrap which extends from a bottom surface of the second base plate and forms in a spiral shape, wherein the rotation shaft includes an oil flow path which is formed therein, an upper frame support portion which is inserted into the upper frame, a boss insertion portion which is recessed from an upper surface of an upper frame support portion for insertion of the boss portion, and an oil residual groove which is recessed by a predetermined depth from a bottom portion of the boss insertion portion.

In addition, the rotation shaft may include an oil flow path which is formed therein, an upper frame support portion which is passed through and inserted into the upper frame, a boss insertion portion which is recessed inward of an upper frame support portion for insertion of the boss portion, and an oil residual groove which is recessed by a predetermined depth from the bottom portion of the boss insertion portion.

An upper end of the oil flow path communicates with the bottom portion of the boss insertion portion, and an oil passage connecting an upper end of the oil flow path and the oil residual groove with each other is formed in the bottom portion.

The oil residual groove is recessed to be deeper than the oil passage.

The oil residual groove is formed at an outer edge of the bottom portion.

The oil residual groove is formed in a band or strip shape along the outer edge of the bottom portion.

The rotation shaft may further include a first recessed portion that is recessed from the inner peripheral surface of the boss insertion portion and a second recessed portion that is recessed from the outer peripheral surface of the boss insertion portion that is opposite to the first recessed portion.

The rotation shaft may further include a guide hole which penetrates the upper frame support portion and connects the first recessed portion and the second recessed portion with each other.

The guide hole may include a first guide hole and a second guide hole which is formed at a position spaced upward from the first guide hole.

The oil residual groove is located below the guide hole.

The scroll compressor according to the embodiment of the present invention having the structure described above has the following effects.

First, since a guide hole for guiding the flow of oil is formed in the upper frame support portion of the rotation shaft, the oil raised along the oil flow path is smoothly and rapidly supplied from the first bearing to the second bearing and generation of frictional force in the bearing can be minimized.

Second, since a plurality of guide holes are arranged in the vertical direction, refrigerant remaining between the first bearing and the rotation shaft can be quickly discharged to the outside of the first bearing at the beginning of compressor driving, and thus there is an effect that the fueling performance and the compression efficiency are improved.

Third, since there is a jaw on the upper portion of the rotation shaft, which can cover the space between the first bearing and the rotation shaft, oil can be prevented from flowing upward through the space between the upper end portion of the rotation shaft and the first bearing and thus there is an advantage that the oil can be appropriately supplied to the second bearing.

Fourth, since the oil passage connecting the upper-end portion of the oil flow path and the recessed portion formed with the guide hole with each other is formed on the bottom of the boss insertion portion, there is an advantage that the oil supplied through the oil flow path is quickly guided toward the guide hole.

Fifth, since the oil residual groove is formed at the bottom of the boss insertion portion, the phenomenon of frictional operation of the bearing portion at the beginning of the compressor driving can be minimized. In addition, since the oil residual groove and the oil flow path are connected with each other by the oil passage, there is an advantage that the oil is quickly supplied to the oil residual groove.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

Hereinafter, a scroll compressor according to an embodiment of the invention is described in detail with reference to the figures.

These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
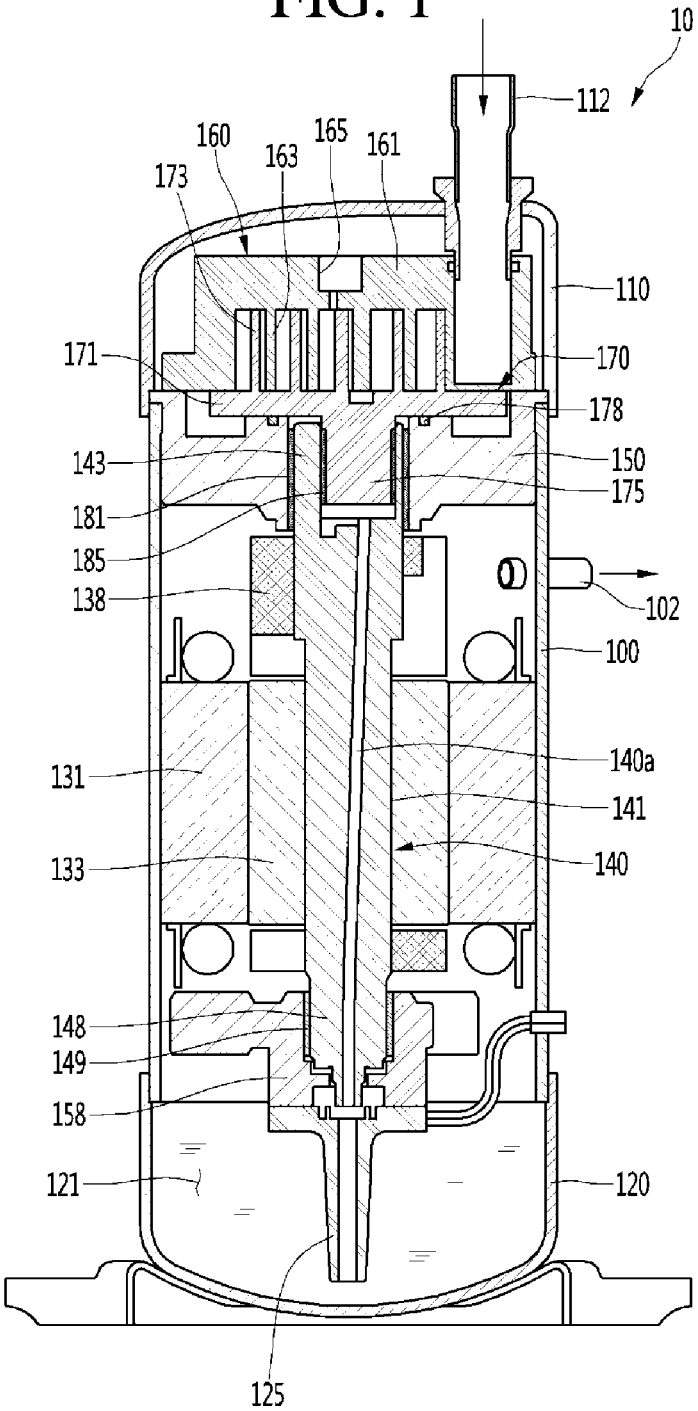
FIG. 1 is a sectional view illustrating a configuration of a scroll compressor according to an embodiment of the invention.

FIG. 1 is a sectional view illustrating a configuration of a scroll compressor according to an embodiment of the invention. With reference to FIG. 1, a scroll compressor 10 may include a cylindrical casing 100, a top cover 110 which covers an upper end of the casing 100, and a bottom cover 120 which covers a lower end of the casing 100.

The casing forms a high-pressure chamber that may be filled with a refrigerant gas to be compressed therein at a high temperature and a high pressure. A discharge portion 102 may be coupled to one side of the casing 100. A suction portion 112 through which the low-temperature and low-pressure refrigerant is suctioned may be coupled to the top cover 110. An oil chamber 121 may be formed in the bottom cover 120.

The casing 100, the top cover 110, and the bottom cover 120 may be collectively referred to as "a sealed container". A scroll compressor in which a refrigerant compressed at a high pressure is contained within the sealed container may be defined as a high-pressure scroll compressor.

A motor may be installed inside the casing 100. The motor may include a stator 131 coupled to an inner wall surface of the casing 100 and a rotor 133 rotatably provided in the stator 131. The scroll compressor 10 may further include a rotation shaft 140 passing through the inside of the rotor 133 and rotating with the rotor 133 in one body.

The rotation shaft 140 may include a shaft portion 141 which extends in the vertical direction (or an axial direction), an upper frame support portion 143 which extends from the upper end of the shaft portion 141, and a lower frame support portion 148 which extends from the lower end of the shaft portion 141.

For example, with reference to FIG. 1, a longitudinal direction is a direction in which the rotation shaft 140 extends and is referred to as "an axial direction," and a direction perpendicular to the axial direction is referred to as a radial direction. The definition of such a direction can be equally applied throughout the specification.

The upper frame support portion 143 is rotatably supported by the first bearing 181. The first bearing 181 may surround an outside of the upper frame support portion 143 and may be positioned on the inner peripheral surface of the upper frame 150. In other words, the first bearing 181 may be located between the outer peripheral surface of the upper frame support portion 143 and the inner peripheral surface of the upper frame 150.

The lower frame support portion 148 may be rotatably supported by a lower bearing 149. The lower bearing 149 surrounds the outside of the lower frame support portion 148 and may be positioned on the inner peripheral surface of the lower frame 158. In other words, the lower bearing 149 may be located between the outer peripheral surface of the lower frame support portion 148 and the inner peripheral surface of the lower frame 158.

An oil supply portion 125 for supplying the oil stored in the oil chamber 121 to the rotation shaft 140 may be provided below the lower frame 158. The oil supply portion 125 may be coupled to the bottom surface of the lower frame 158. The oil stored in the oil chamber 121 may be supplied upwardly through the oil supply portion 125 and may flow along the oil flow path 140*a* of the rotation shaft 140.

The oil flow path 140*a* may extend upwardly through the inside of the rotation shaft 140 and guide the oil supplied from the oil supply portion 125 to the upper side of the rotation shaft 140. A boss portion of the orbiting scroll 170 may be eccentrically coupled to an upper end of the rotation shaft 140, and the oil flow path 140*a* may extend to be inclined by a predetermined angle from a vertical line. In other words, the oil flow path 140*a* may be formed to be inclined in a direction that extends away from the center of the rotation shaft 140 and toward the upper end of the rotation shaft 140 from the lower end thereof. As a result, the oil flowing along the oil flow path 140*a* is raised by centrifugal force.

The upper frame 150 may be coupled to an inner wall surface of the casing 100 and include an inner peripheral surface on which the first bearing 181 is installed or attached. The first bearing 181 is configured to support the rotation shaft 140 so that the rotation shaft 140 can smoothly rotate.

An orbiting scroll 170 may be disposed on the upper surface of the upper frame 150. The orbiting scroll 170 may include a first base plate portion (or a first base plate) 171 having a substantially disc shape and disposed on the upper surface of the upper frame 150, an orbiting wrap 173 which extends in an upward direction from the first base plate portion 171 and is formed having a spiral shape, and a boss portion 175 which extends from the bottom surface center of the first base plate portion 171.

The orbiting wrap 173 forms a compression chamber together with the stationary wrap 163 of the stationary scroll 160 to be described below. The orbiting scroll 170 may be referred to as "a first scroll" and the stationary scroll 160 as "a second scroll" or "a non-orbiting scroll".

The first base plate portion 171 of the orbiting scroll 170 orbits in a state of being supported on the upper surface of the upper frame 150. An Oldham ring 178 is preferably installed between the bottom surface of the first base plate portion 171 and the upper surface of the upper frame 150 in order to prevent the orbiting scroll 170 from rotating.

The boss portion 175 is configured to be inserted into an upper frame support portion 143 which is recessed at a predetermined depth from the upper surface of the rotation shaft 140. The rotation force of the rotation shaft 140 is transmitted to the orbiting scroll 170. The central portion of the upper frame support portion 143 and the central portion of the boss portion 175 are eccentric portions. Accordingly, the orbiting scroll 170 can be swiveled by the rotation of the rotation shaft 140.

An eccentric mass 138 for canceling an eccentric load generated while the orbiting scroll 170 is swiveled may be coupled to the upper portion of the shaft portion 141. For example, the eccentric mass 138 may be coupled to the outer peripheral surface of the shaft 141.

A second bearing 185 for supporting the movement of the orbiting scroll 170 may be provided on an outer peripheral surface of the boss portion 175. The second bearing 185 may be disposed between the inner peripheral surface of the upper frame support portion 143 and the outer peripheral surface of the boss portion 175.

As shown, the stationary scroll 160 engaged with the orbiting scroll 170 is disposed above the orbiting scroll 170. The stationary scroll 160 includes a second base plate portion (or a second base plate) 161 having a substantial disc shape and a stationary wrap 163 which extends from the bottom surface of the second base plate portion 161 in a direction towards the first base plate portion 171 and engages with the orbiting wrap 173 of the orbiting scroll 170.

The second base plate portion 161 forms an upper portion of the stationary scroll 160 as a main body of the stationary scroll 160. The stationary wrap 163 extends in a downward direction from the second base plate portion 161 and forms a lower portion of the stationary scroll 160. The orbiting wrap 173 may be referred to herein as "a first wrap", and the stationary wrap 163 may be referred to herein as a "second wrap".

The lower end portion of the stationary wrap 163 may be in contact with the first base plate portion 171 and the end portion of the orbiting wrap 173 may be in contact with the second base plate portion 161. The length of the orbiting wrap 173 extending from the first base plate portion 171 to the second base plate portion 161 and the length of the stationary wrap 163 extending from the second base plate portion 161 to the first base plate portion 161 may be identical to each other, or different. The length is referred to herein as the "height" of the wrap.

The stationary wrap 163 may extend to form a predetermined spiral shape and a discharge port 165 through which the compressed refrigerant may be discharged is formed in a substantially central portion of the second base plate portion 161. The suction portion 112 may be coupled to an outer edge of the stationary scroll 160 through an upper surface of the top cover 110. The refrigerant suctioned through the suction portion 112 may flows into the compression chamber defined by the orbiting wrap 173 and the stationary wrap 163.

At least a portion of the oil supplied through the oil flow path 140*a* may be supplied to the compression chamber via the orbiting scroll 170 and the stationary scroll 160. The remaining portion of oil may be supplied to the inner peripheral surface and the outer peripheral surface of the upper frame support portion 143, that is, to the second bearing 185 and the first bearing 181 side to perform lubrication and cooling function and can be supplied to the compression chamber. Hereinafter, the structure and operation relating to the oil supply flow path is described with reference to the figures.

Figure 2:
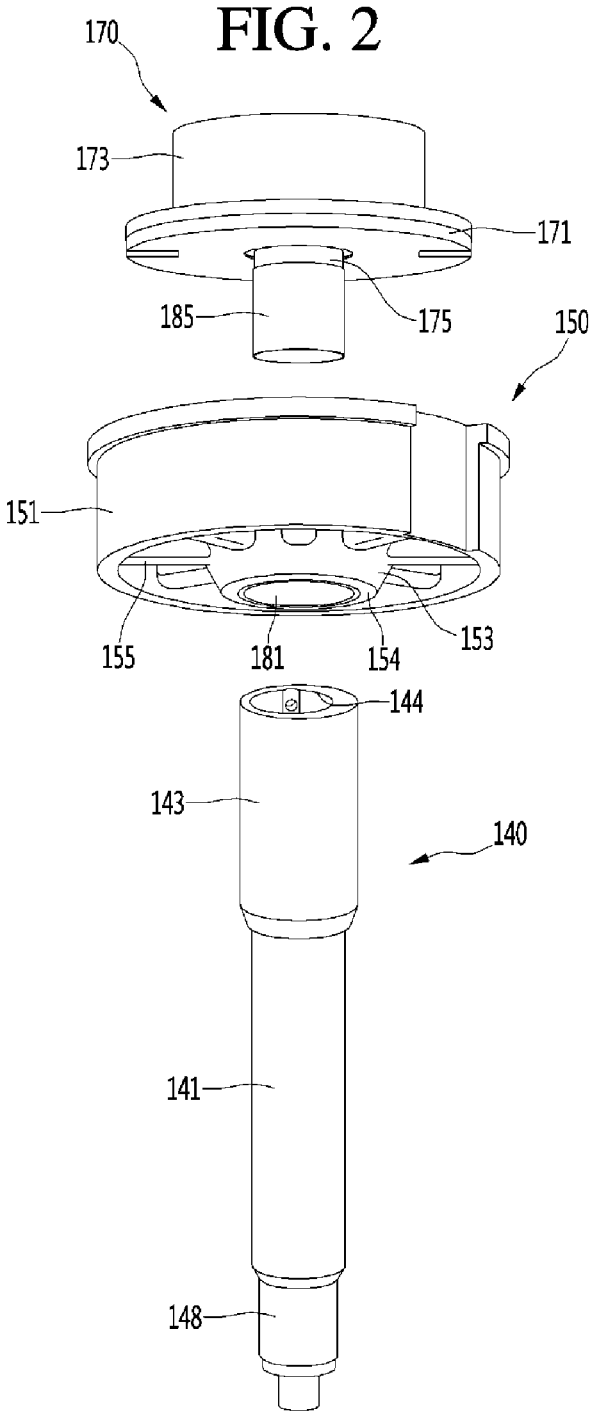
FIG. 2 is a sectional view illustrating a portion of the configuration of the scroll compressor according to an embodiment of the invention.
Figure 3:
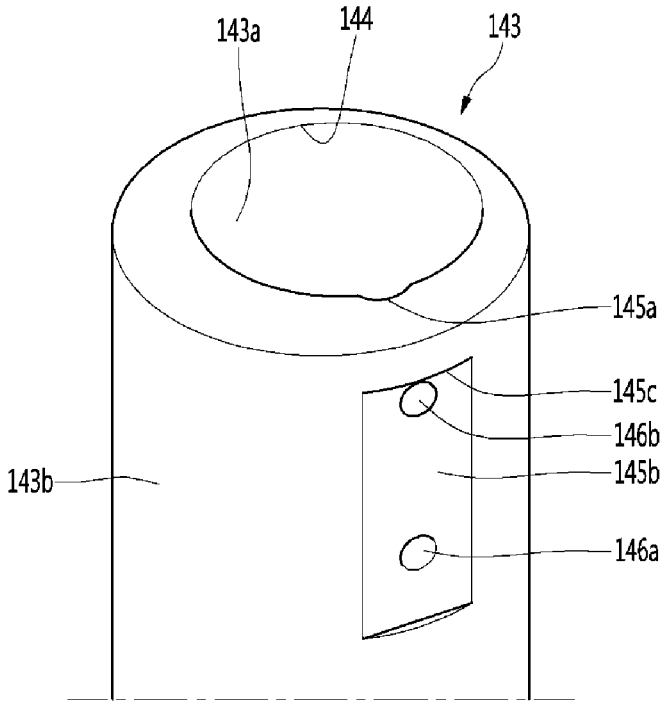
FIG. 3 is a perspective view illustrating an upper structure of a rotation shaft according to an embodiment of the invention.
Figure 4:
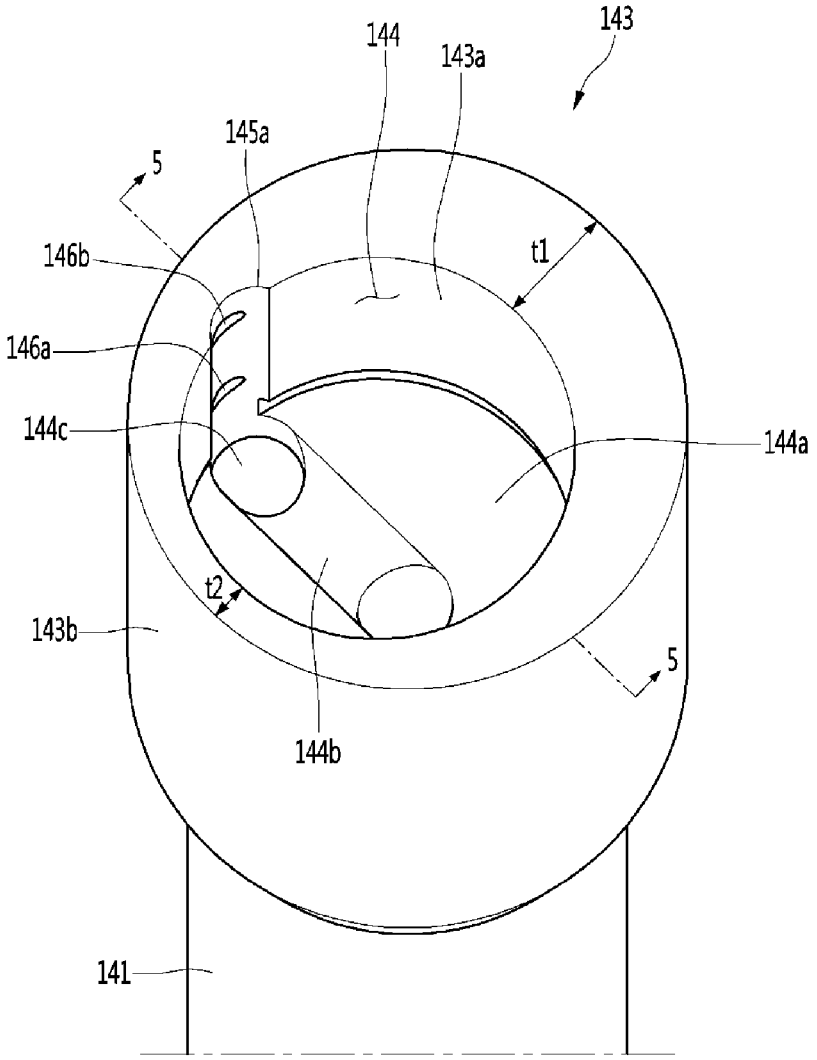
FIG. 4 is a perspective view illustrating an upper structure of a rotation shaft according to an embodiment of the invention.
Figure 5:
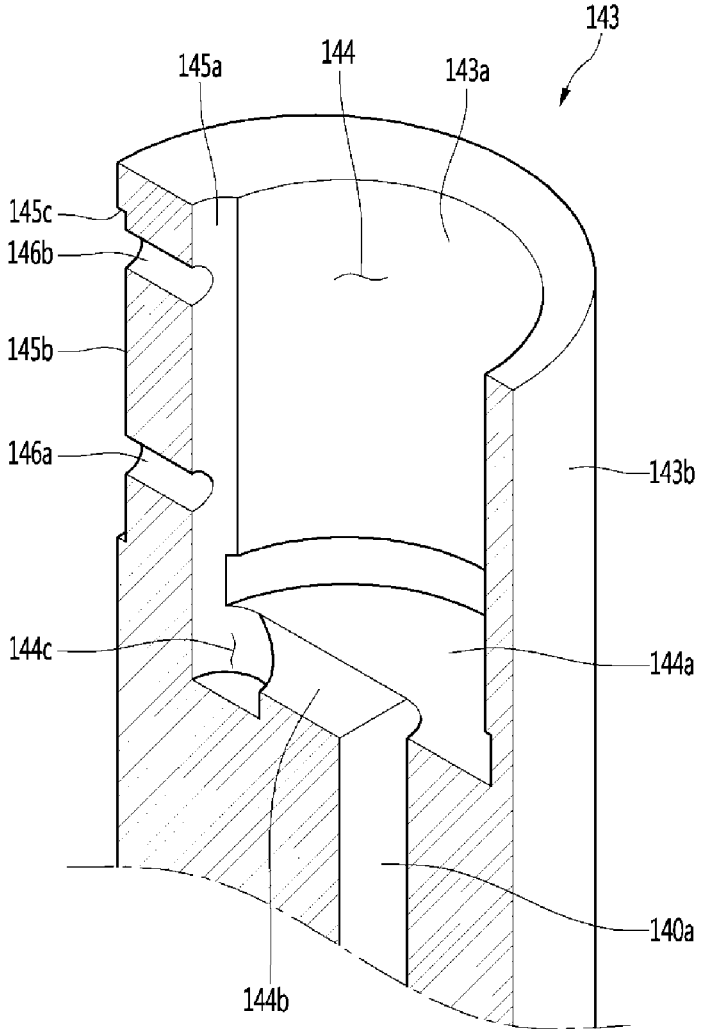
FIG. 5 is a longitudinal sectional view cut taken along line 5-5 of FIG. 4.

FIG. 2 is a sectional view illustrating a portion of the configuration of the scroll compressor according to an embodiment of the invention, FIGS. 3 and 4 are perspective views illustrating an upper structure of a rotation shaft according to an embodiment of the invention. FIG. 5 is a longitudinal sectional view cut taken along line 5-5 of FIG. 4.

With reference to FIGS. 2-5, a scroll compressor 10 may include a rotation shaft 140, an upper frame 150, and a orbiting scroll 170.

The upper frame 150 may include a frame outer wall 151 having a substantially annular shape, a frame inner wall 153 disposed on the inner side of the frame outer wall 151, and a frame extension portion 155 which connects the frame inner wall 153 and the frame outer wall 151 with each other.

The frame inner wall 153 is formed with a shaft insertion portion 154 into which the upper frame support portion 143 of the rotation shaft 140 may be inserted. The shaft insertion portion 154 may have a first bearing 181 and the upper frame support portion 143 may be coupled to the inside of the first bearing 181.

The upper frame support portion 141 may have an outer diameter that is larger than the outer diameter of the shaft portion 141. As such, the upper frame support portion 141 can receive the boss portion 175 of the orbiting scroll 170. The outer diameter of the shaft portion 141 may be larger than the outer diameter of the lower frame support portion 148.

The upper frame support portion 143 and the first bearing 181 may be inserted into the shaft insertion portion 154 and the boss portion 175 and the second bearing 185 may be inserted into the upper frame support portion 143.

Accordingly, the upper frame support portion 143 is preferably formed with a boss insertion portion 144 for inserting the boss portion 175 and the second bearing 185 therein. The boss insertion portion 144 may be formed to be recessed from the upper end of the upper frame support portion 143 with a predetermined diameter and a predetermined depth.

The upper frame support portion 143 may include an inner peripheral surface portion 143*a* defining the bearing insertion portion 144 and an outer peripheral surface portion 143*b* defining the outer surface of the upper frame support portion 143. The upper end of the oil flow path 140*a* may be formed in the bottom portion 144*a* of the boss insertion portion 144 and the upper-end portion of the oil flow path 140*a* may be formed at a position that is spaced apart from the center of the bottom portion 144*a* in the radial direction.

An oil residual groove 144*c* may be formed at an outer edge of the bottom portion 144*a*. The oil residual groove 144*c* may be formed at a point farthest from the upper end of the oil flow path 140*a* by a straight line.

The oil residual groove 144*c* and the upper-end portion of the oil flow path 140*a* may be connected with each other by an oil passage 144*b*. The recessed depth of the oil passage 144*b* may become gradually deeper toward the oil residual groove 144*c*. Alternatively, the bottom of the oil passage 144*b* may be formed horizontally such that the depth remains the same.

The depth of the oil passage 144*b* may be shallower than the depth of the oil residual groove 144*c*. In other words, the bottom of the oil passage 144*b* formed at the edge of the oil residual groove 144*c* may be formed at a position spaced upward from the bottom of the oil residual groove 144*c* by a predetermined height. According to this configuration, even if the compressor stops operating, the oil remaining in the oil residual groove 144*c* at the beginning of the operation of the compressor is supplied to the first bearing 181 and the second bearings 185.

A first recessed portion 145*a* may be formed in the inner peripheral surface portion 143*a* of the upper frame support portion 143. The first recessed portion 145*a* may be recessed with a predetermined width and depth from the inner peripheral surface portion 143*b* and may have a length extending from the upper end to the lower end of the inner peripheral surface portion 143*b*.

Due to the configuration of the first recessed portion 145*a*, the space formed by the first recessed portion 145*a* and the second bearing 185 functions as an oil supply flow path 147*a* through which the oil flows. This oil supply flow path may be referred to herein as a "first supply flow path 147*a* (see FIG. 6)".

The second recessed portion 145*b* may be formed on the outer peripheral surface portion 143*b* of the upper frame support portion 143. The second recessed portion 145*b* may have a shape recessed radially inward from the outer peripheral surface portion 143*b*. The second recessed portion 145*b* may extend vertically. The second recessed portion 145*b* may be formed on the opposite side of the first depressed portion 145*a*.

The space formed by the second recessed portion 145*b* and the first bearing 181 may operate as an oil supply flow path 147*b* through which the oil flows. Such oil supply flow path may be referred to herein as "a second supply flow path 147*b* (see FIG. 6)".

The first supply flow path 147*a* may be used to transfer the oil discharged from the oil flow path 140*a* to the second supply flow path 147*b*.

A step 145*c* may be formed at an upper end of the second recessed portion 145*b*. The step 145*c* may restrict or prevent the oil flowing through the second supply flow path 147*b* from flowing upward through the upper-end portion of the upper frame support portion 143. With such configuration, the oil supplied through the oil flow path 140*a* of the rotation shaft 140 may be prevented from converging on the second supply flow path 147*b* and can be appropriately supplied to the first supply flow path 147*a*.

The upper frame support portion 143 may be formed with guide holes 146*a* and 146*b* for communicating the first supply flow path 147*a* and the second supply flow path 147*b* with each other. The guide holes 146*a* and 146*b* may extend from the first recessed portion 145*a* toward the second recessed portion 145*b*. In other words, the guide holes 146*a* and 146*b* may be penetrated from the first recessed portion 145*a* to the second recessed portion 145*b*.

A plurality of guide holes 146*a* and 146*b* may be provided. The plurality of guide holes 146*a* and 146*b* may be spaced apart from each other in the vertical direction. As shown, the plurality of guide holes 146*a* and 146*b* may include a first guide hole 146*a* and a second guide hole 146*b* on the upper side of the first guide hole 146*a*.

The oil may flow from the first supply flow path 147*a* to the second supply flow path 147*b* or from the second supply flow path 147*b* to the first supply flow path 147*a*, through the guide holes 146*a* and 146*b*. For example, when the scroll compressor 10 is initially started, gaseous refrigerant (R: see FIG. 7) remaining in the second supply flow path 147*b* is sometimes discharged from the second supply flow path 147*b* together with the oil. As a result, the phenomenon that the flow of the oil is obstructed by the gaseous refrigerant, e.g., the vapor lock phenomenon, can be prevented.

Meanwhile, the thickness of the upper frame support portion 143, that is, the distance from the inner peripheral surface portion 143*a* to the outer peripheral surface portion 143*b*, may not be uniform in the circumferential direction. For example, as illustrated in FIG. 4, the thickness t1 of one point of the upper frame support portion 143 may be formed to be greater than the thickness t2 of the other point of the upper frame support portion 143. With such a configuration, the boss portion 175 of the orbiting scroll 170 can be eccentrically coupled to the upper frame support portion 143.

Figure 6:
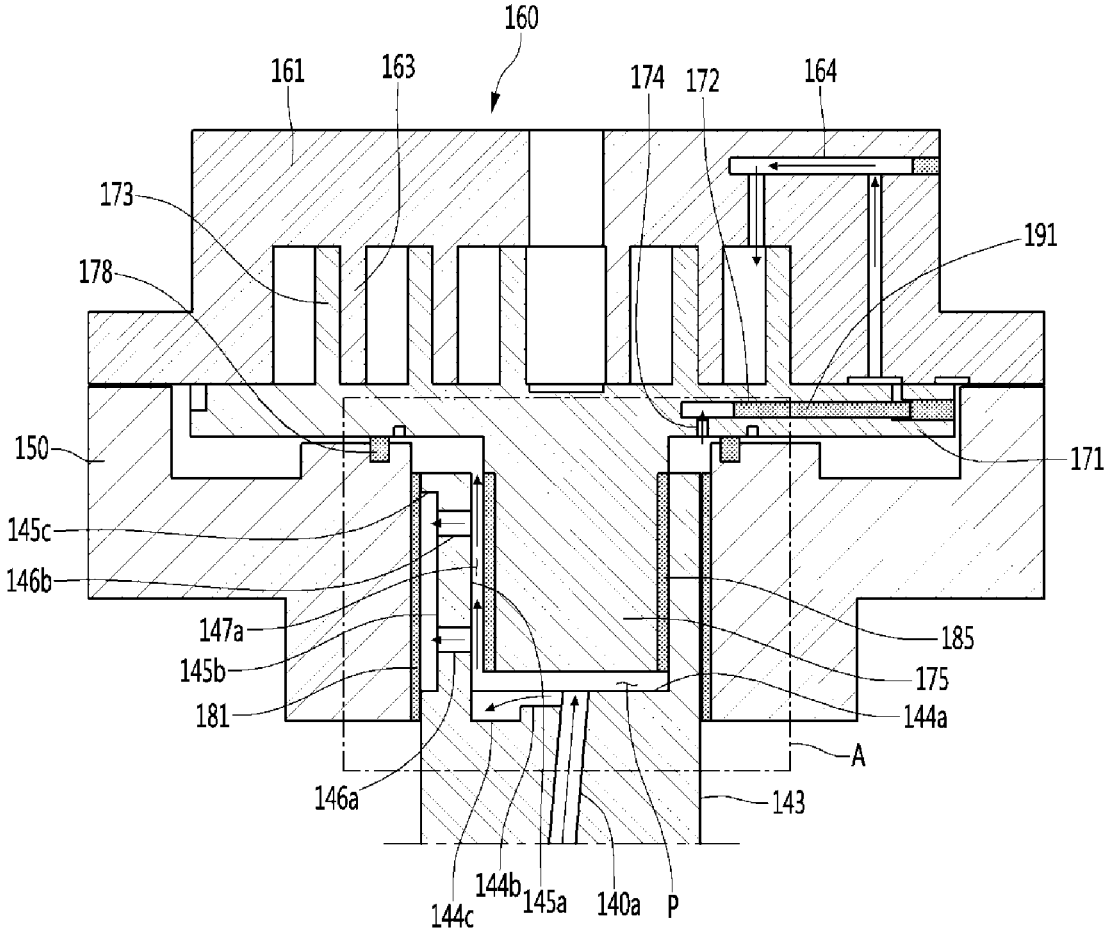
FIG. 6 is a sectional view illustrating a coupling structure of the rotation shaft, an orbiting scroll, and a main frame according to an embodiment of the present invention.
Figure 7:
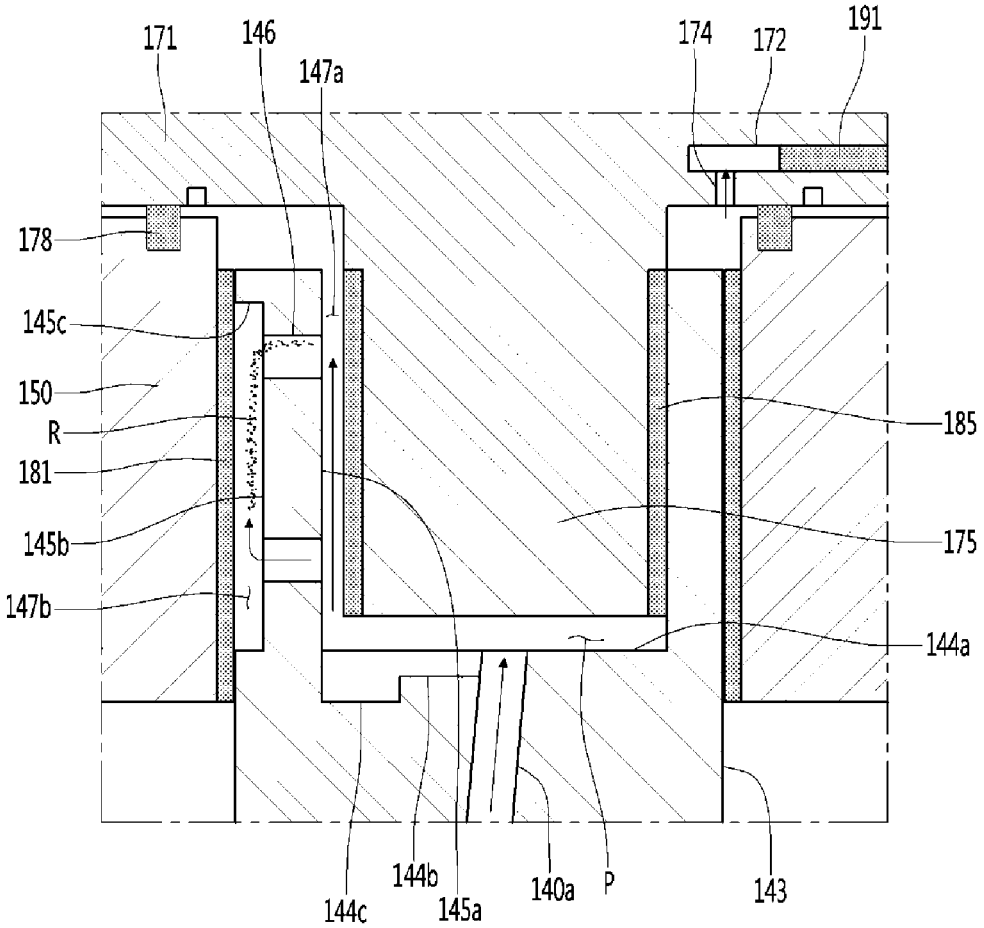
FIG. 7 is an enlarged view illustrating portion "A" in FIG. 6.

FIG. 6 is a sectional view illustrating a coupling structure of a rotation shaft, an orbiting scroll, and a main frame according to an embodiment of the invention. FIG. 7 is an enlarged view illustrating portion "A" in FIG. 6.

With reference to FIGS. 6 and 7, the scroll compressor 10 includes a pressure reduction pin 191 for lowering the pressure of the oil. The first base plate portion 171 of the orbiting scroll 170 may be formed with a pin insertion portion 172 to which the pressure reduction pin 191 is installed. Since the pressure reduction pin 191 is provided in the pin insertion portion 172, space through which the oil flows can be reduced and thus the pressure of the oil can be lowered.

The pin insertion portion 172 may be formed on the first base plate portion 171 and may extend in the radial direction. A communication hole 174 for guiding the oil discharged from the rotation shaft 140 to the pin insertion portion 172 may be formed on the bottom surface of the first base plate portion 171.

As described above, the inside of the casing 100 forms a high pressure, and the pressure of the oil supplied from the oil chamber 121 to the rotation shaft 140 also forms a high pressure. On the other hands, the refrigerant suctioned into the compression chamber through the suction portion 112 can form a low pressure. Consequently, the oil can flow upward from the oil chamber 121 as a result of the pressure difference between the high pressure inside the casing 100 and the low pressure formed on the suction side of the compression chamber.

The pressure of the oil must be reduced in order to balance the pressure of the oil flowing into the compression chamber and the pressure of the suction side of the compression chamber. Specifically, the oil discharged from the rotation shaft 140 flows to the pin insertion portion 172 through the communication hole 174. The pressure of the oil can be lowered as the oil passes through the pin insertion portion 172 that is narrowed by the pressure reduction pin 191. The oil with lowered pressure can be supplied to the compression chamber to perform the lubricating action.

The stationary scroll 160 is provided with a guide flow path 164 for guiding the flow of oil. The guide flow path 164 is in communication with the pin insertion portion 172 and may extend to the compression chamber. The oil that passes through the pin insertion portion 172 can be supplied to the compression chamber via the guide flow path 164.

The flow of the oil discharged from the oil flow path 140*a* is described in more detail below.

The oil stored in the oil chamber 121 may rise along the oil flow path 140*a* based on the difference in pressure between the high pressure inside the casing 100 and the low pressure at the suction portion 112 side.

At least a portion of the oil discharged from the oil flow path 140*a* flows through a space between the second bearing 185 and the inner peripheral surface portion 143*a* and flows toward the pin insertion portion 1712 side of the orbiting scroll 170 via the communication hole 174.

The remaining portion of oil in the oil discharged from the oil flow path 140*a* flows into the oil residual groove 144*c* along the oil passage 144*b* to be filled in the oil residual groove 144*c*. The oil filled in the oil residual groove 144*c* may flow in the guide holes 146*a* and 146*b* via the first supply flow path 147*a* between the second bearing 185 and the first recessed portion 145*a*. The oil that passes through the guide holes 146*a* and 146*b* may then flow into the second supply flow path 147*b* between the first bearing 181 and the second recessed portion 145*b*.

Since the plurality of guide holes 146 may be spaced apart from each other in the vertical direction, the oil may flow into the lower portion and the upper portion of the second supply flow path 147*b* through the plurality of guide holes 146. For example, the oil flows into the lower portion of the second supply flow path 147*b* through the first guide hole 146*a* and flows into the upper portion of the second supply flow path 147*b* through the second guide hole 146*b*.

The oil of the second supply flow path 147*b* may be restricted from flowing to the upper-end portion of the outer peripheral surface portion 143*b* by the step 145*c*. Therefore, the oil flowing into the second supply flow path 147*b* may flow into the first supply flow path 147*a* again through the first guide hole 146*a* or the second guide hole 146*b*.

The oil in the first supply flow path 147*a* may flow in an upper side of the first recessed portion 145*a* and may flow into the pin insertion portion 172 through the communication hole 174.

On the other hand, when the compressor is stopped, the oil in the first supply flow path 147*a* flows down and collects in the oil residual groove 144*c*. When the compressor is started again, the oil in the oil residual groove 144*c* rapidly flows into the first supply flow path 147*a*, the second supply flow path 147*b*, and the pin insertion portion 172. It is thus possible to minimize the phenomenon that the bearing portion is worn or damaged due to friction.

Figure 8:
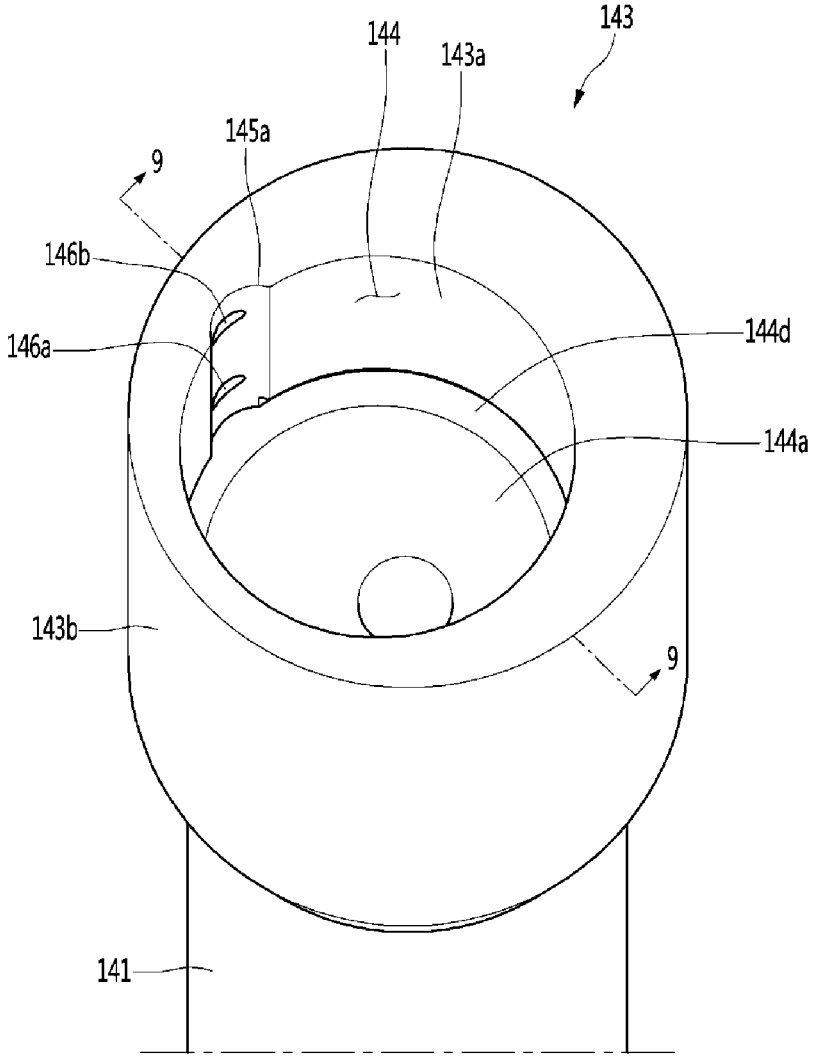
FIG. 8 is a perspective view illustrating an upper frame support portion according to another embodiment of the invention.
Figure 9:
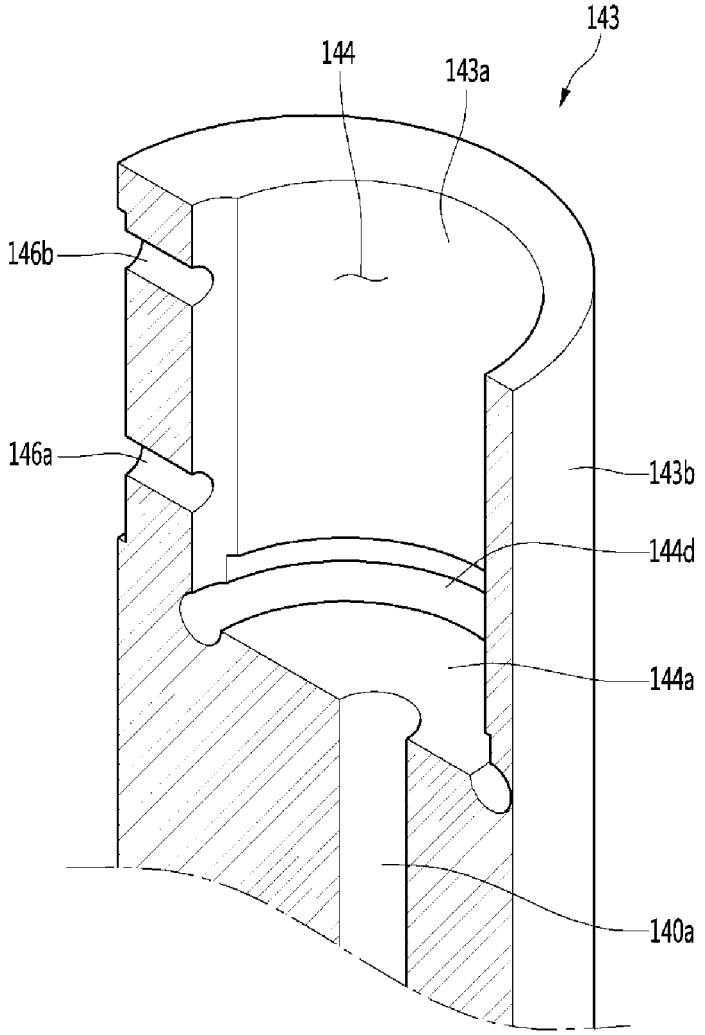
FIG. 9 is a longitudinal sectional cut-away perspective view cut along the line 9-9 in FIG. 8.

FIG. 8 is a perspective view illustrating an upper frame support portion according to another embodiment of the invention. FIG. 9 is a longitudinal sectional cut-away perspective view cut along line 9-9 in FIG. 8.

Hereinafter, a separate description of the portions having the same structure as those of the upper frame support portion according to the previous embodiment is omitted, and the differences from the previous embodiment is mainly described.

With reference to FIGS. 8 and 9, the upper frame support portion 143 is characterized in that an oil residual groove 144*d* is formed at the edge of the bottom portion 144*a* of the boss insertion portion 144. In other words, the oil residual groove 144*d* is surrounded by the outer edge of the bottom portion 144*a*, that is, at the corner portion where the inner peripheral surface portion 143*a* and the bottom portion 144*a* meet, in the form of a circular band or strip. The oil residual groove 144*d* may have a shallower depth than the oil residual groove 144*c*.

In addition, as in the previous embodiment, an oil passage connecting the oil residual groove 144*d* from the upper end of the oil flow path 140*a* may be formed.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor comprising:

a rotation shaft;

an upper frame to support an upper end of the rotation shaft;

a lower frame to support a lower end of the rotation shaft;

an orbital scroll comprising a first base plate that is attached to the upper frame, a first wrap having a spiral shape that extends from an upper surface of the first base plate, and a boss portion that extends from a bottom surface of the first base plate; and a non-orbital scroll comprising a second base plate that covers an upper side of the orbital scroll, and a second wrap having a spiral shape that extends from a bottom surface of the second base plate, wherein the rotation shaft comprises:

an oil flow path formed therein, an upper frame support portion that is inserted into the upper frame, a boss insertion portion to receive the boss portion, the boss insertion portion being recessed from an upper surface of the upper frame support portion and defined by a bottom surface and an inner peripheral surface of the upper frame support portion, an oil residual groove that is downwardly recessed from the bottom surface of the boss insertion portion to a depth below the bottom surface of the boss insertion portion, a first recessed portion that is recessed from the inner peripheral surface of the upper frame support portion, a second recessed portion that is recessed from an outer peripheral surface of the upper frame support portion, one or more guide holes which penetrate the upper frame support portion and connects the first recessed portion with the second recessed portion, and wherein an upper end of the oil flow path spaced apart from the oil residue groove is formed at the bottom surface and the bottom surface of the boss insertion portion is configured to face a lower end of the boss portion, wherein the upper end of the flow path is in communication with the bottom surface of the boss insertion portion, and wherein an oil passage that connects the upper end of the oil flow path with the oil residual groove is formed in the bottom portion of the boss insertion portion.

2. The scroll compressor of claim 1, wherein the oil passage is configured to be recessed from the bottom surface and the oil residual groove is recessed to a depth that is below the oil passage.

3. The scroll compressor of claim 1, wherein the oil residual groove is provided at an outer edge portion of the bottom surface of the boss insertion portion.

4. The scroll compressor of claim 1, wherein the oil residual groove is formed in a recessed portion of a circular band or strip shape along the outer edge of the bottom surface.

5. The scroll compressor of claim 1, wherein the one or more guide holes comprise:

a first guide hole; and a second guide hole located above the first guide hole.

6. The scroll compressor according to claim 1, wherein the oil residual groove is located below the one or more guide holes.

7. The scroll compressor according to claim 1, further comprising a motor to power the rotation shaft, the motor being coupled to an outer peripheral surface of the rotation shaft.

* * * * *